US008512064B1

(12) United States Patent
Kwankijpongsa et al.

(10) Patent No.: US 8,512,064 B1
(45) Date of Patent: Aug. 20, 2013

(54) INTEGRATED ELECTRIC CONNECTOR AND CONNECTING AND GUIDING MECHANISM THEREOF

(75) Inventors: Surawut Kwankijpongsa, Samutprakam (TH); Jui-Ching Huang, Samutprakam (TH)

(73) Assignee: Delta Electronics (Thailand) Public Co., Ltd., Samutprakarn (TH)

( * ) Notice: Subject to any disclaimer, the term of this patent is extended or adjusted under 35 U.S.C. 154(b) by 0 days.

(21) Appl. No.: 13/368,818

(22) Filed: Feb. 8, 2012

(51) Int. Cl.
*H01R 13/64* (2006.01)

(52) U.S. Cl.
USPC ..... 439/374

(58) Field of Classification Search
USPC ..... 439/374, 297, 387, 131; 348/837; 165/80.4; 361/679.55
See application file for complete search history.

(56) References Cited

U.S. PATENT DOCUMENTS

| | | | | |
|---|---|---|---|---|
| 4,842,544 | A * | 6/1989 | Birch et al. | 439/387 |
| 5,882,220 | A * | 3/1999 | Horii et al. | 439/297 |
| 6,042,414 | A * | 3/2000 | Kunert | 439/374 |
| 6,301,106 | B1 * | 10/2001 | Helot et al. | 361/679.55 |
| 6,626,686 | B1 * | 9/2003 | D'Souza et al. | 439/131 |
| 6,633,482 | B2 * | 10/2003 | Rode | 361/679.4 |
| 6,695,637 | B1 * | 2/2004 | Liu | 439/377 |
| 7,338,328 | B2 * | 3/2008 | Krieger et al. | 439/668 |
| 7,755,890 | B2 * | 7/2010 | Rui et al. | 361/679.55 |
| 7,988,469 | B1 * | 8/2011 | Sun et al. | 439/140 |
| 8,113,855 | B2 * | 2/2012 | Green et al. | 439/131 |
| 8,241,049 | B2 * | 8/2012 | Sun | 439/142 |
| 8,254,846 | B2 * | 8/2012 | Seil et al. | 455/66.1 |
| 8,298,003 | B2 * | 10/2012 | Wu | 439/501 |
| 2005/0161197 | A1 * | 7/2005 | Rapaich | 165/80.4 |

* cited by examiner

*Primary Examiner* — Alexander Gilman
(74) *Attorney, Agent, or Firm* — Kirton McConkie; Evan R. Witt

(57) ABSTRACT

An integrated electric connector includes a main body, a first electric connector, a casing, a second electric connector, a third electric connector, and a guiding member. The first electric connector is at least partially protruded from the main body and connected with a transmission cable. The second electric connector is installed in the casing, and connectable with the first electric connector. The third electric connector is disposed on the casing and connected with the second electric connector. The guiding member is connected with the casing. The first electric connector is guided by the guiding member to be detachably connected with the second electric connector. The first electric connector is directly connected with the electronic device, or the first electric connector is indirectly connected with the electronic device through the second electric connector and the third electric connector.

7 Claims, 6 Drawing Sheets

INTEGRATED ELECTRIC CONNECTOR AND CONNECTING AND GUIDING MECHANISM THEREOF

FIELD OF THE INVENTION

The present invention relates to an electric connector, and more particularly to an integrated electric connector. The present invention also provides a connecting and guiding mechanism of the integrated electric connector.

BACKGROUND OF THE INVENTION

With increasing development of science and technology, a variety of electronic devices play important roles in modern societies. These electronic devices are in close relation to daily lives and widely used in various fields. These electronic devices are for example smart phones, tablet personal computers, digital cameras, card readers, and external storage media. That is, these electronic devices have become popular consumer electronic products.

Generally, the electronic device is connected with a personal computer or another electronic device through a transmission cable in order to perform various actions such as data transmission, photo-sharing actions, charging actions and data synchronization. Generally, various electronic devices have specified transmission interfaces such as USB connectors, Mini USB connectors, Micro USB connectors, Apple 30-pin dock connectors, or the like. Through a transmission cable matching the transmission interface, the electronic device can be in communication with a personal computer or another electronic device. Conventionally, since various types of transmission cables should be prepared to comply with diversified transmission interfaces, it is very troublesome for the user to prepare and store these transmission cables. For solving these drawbacks, an integrated electric connector with various transmission interfaces has been disclosed. The integrated electric connector is produced by connecting a plurality of electric connectors in series. According to the user's requirements, the integrated electric connector can be applied to various electronic devices.

Conventionally, a plurality of electric connectors are directly combined together or indirectly combined together through a coupling mechanism in order to assemble the integrated electric connector. During the process of assembling the integrated electric connector, poor contact or permanent damage may occur in electric connectors, if the external force is inadvertently applied to the connector, or the connectors are assembled improperly, such as accidentally plug connectors upside down. Under this circumstance, the possibility of causing a short-circuited problem or an erroneous wiring problem will be increased, and thus the electronic device may be burnt out. Moreover, in a case that some of the electric connectors are disassembled from the integrated electric connector, it is difficult and troublesome for the user to store the electric connectors. Under this circumstance, some components of the integrated electric connector are possibly lost.

Therefore, there is a need of providing an improved integrated electric connector in order to obviate the drawbacks encountered in the prior art.

SUMMARY OF THE INVENTION

The present invention provides an integrated electric connector and a connecting and guiding mechanism thereof in order to minimize the possibility of inadvertently applying force or causing improper assembling direction and to minimize possibility of losing any component of the integrated electric connector.

The present invention also provides an integrated electric connector and a connecting and guiding mechanism thereof. Via a guiding member, a first electric connector is guided to be detachably connected with the second electric connector. Since the connecting and guiding mechanism has a foolproof function, the possibility of inadvertently applying force or causing improper assembling direction will be minimized.

The present invention further provides an integrated electric connector and a connecting and guiding mechanism thereof. Since the guiding member and the casing of the integrated electric connector are switchable, the desired electric connector may be selected according to the user's requirement without the need of disassembling any components. In other words, the integrated electric connector of the present invention is easily stored, and the possibility of losing any component of the integrated electric connector will be minimized.

In accordance with an aspect of the present invention, there is provided an integrated electric connector for connecting a transmission cable with an electronic device. The integrated electric connector at least includes a main body, a first electric connector, a casing, a second electric connector, a third electric connector, and a guiding member. The main body includes a first guiding part and a second guiding part. The first electric connector is at least partially protruded from the main body and connected with the transmission cable. The casing is located beside the first electric connector. The second electric connector is installed in the casing, and connectable with the first electric connector. The third electric connector is disposed on the casing and connected with the second electric connector. The second electric connector and the third electric connector are opposed to each other with respect to the casing. The guiding member is connected with the casing, and includes a third guiding part and a fourth guiding part. The third guiding part and the fourth guiding part match the first guiding part and the second guiding part, respectively. The first electric connector is guided by the guiding member to be detachably connected with the second electric connector. The first electric connector is directly connected with the electronic device, or the first electric connector is indirectly connected with the electronic device through the second electric connector and the third electric connector.

In accordance with another aspect of the present invention, there is provided a connecting and guiding mechanism of an integrated electric connector. A transmission cable is connected with an electronic device through said integrated electric connector. The integrated electric connector includes a main body and a first electric connector. The main body has a first guiding part and a second guiding part. The first electric connector is at least partially protruded from the main body and connected with the transmission cable. The connecting and guiding mechanism at least includes a casing, a second electric connector, a third electric connector, and a guiding member. The casing is located beside the first electric connector. The second electric connector is installed in the casing, and connectable with the first electric connector. The third electric connector is disposed on the casing and connected with the second electric connector. The second electric connector and the third electric connector are opposed to each other with respect to the casing. The guiding member is connected with the casing, and includes a third guiding part and a fourth guiding part. The third guiding part and the fourth guiding part match the first guiding part and the second guiding part, respectively. The first electric connector is guided by the guiding member to be detachably connected with the second electric connector. The first electric connector is directly connected with the electronic device, or the first electric connector is indirectly connected with the electronic device through the second electric connector and the third electric connector.

In accordance with a further aspect of the present invention, there is provided an integrated electric connector for connecting a transmission cable with an electronic device. The integrated electric connector at least includes a main body, a first electric connector, a first casing, a second electric connector, a third electric connector, a first guiding member, a second casing, a fourth electric connector, a fifth electric connector, a fifth electric connector, and a second guiding member. The main body includes a first guiding part and a second guiding part. The first electric connector is at least partially protruded from the main body and connected with the transmission cable. The first casing is located beside the first electric connector. The first casing has another first end part and another second end part. The first guiding part and the second guiding part are located at the second end part of the first casing. The second electric connector is installed in the first casing, and connectable with the first electric connector. The third electric connector is disposed on the second end part of the first casing and connected with the second electric connector. The second electric connector and the third electric connector are opposed to each other with respect to the first casing. The first guiding member is connected with the first end part of the first casing, and includes a third guiding part and a fourth guiding part. The third guiding part and the fourth guiding part of the first guiding member match the first guiding part and the second guiding part of the main body, respectively. The second casing is located beside the third electric connector. The fourth electric connector is installed in the second casing, and connectable with the third electric connector. The fifth electric connector is disposed on the second casing and connected with the fourth electric connector. The fourth electric connector and the fifth electric connector are opposed to each other with respect to the second casing. The second guiding member is connected with the second casing, and includes another third guiding part and another fourth guiding part. The third guiding part and the fourth guiding part of the second guiding member match the first guiding part and the second guiding part of the first casing, respectively. The first electric connector is guided by the first guiding member to be detachably connected with the second electric connector, and the third electric connector is guided by the second guiding member to be detachably connected with the fourth electric connector. The first electric connector is directly connected with the electronic device, or the first electric connector is indirectly connected with the electronic device through the second electric connector and the third electric connector, or the first electric connector is indirectly connected with the electronic device through the second electric connector, the third electric connector, the fourth electric connector and the fifth electronic connector.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
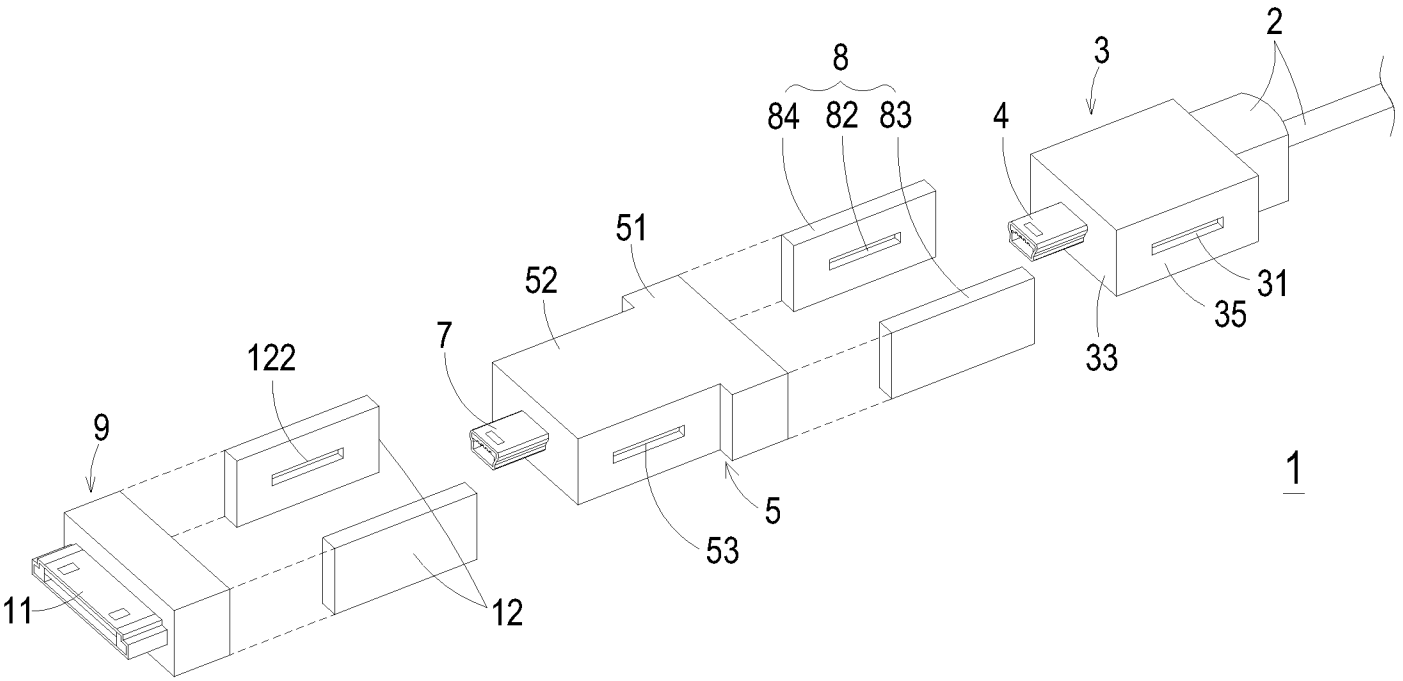
FIG. 1 is a schematic exploded view illustrating an integrated electric connector according to an embodiment of the present invention.
Figure 2:
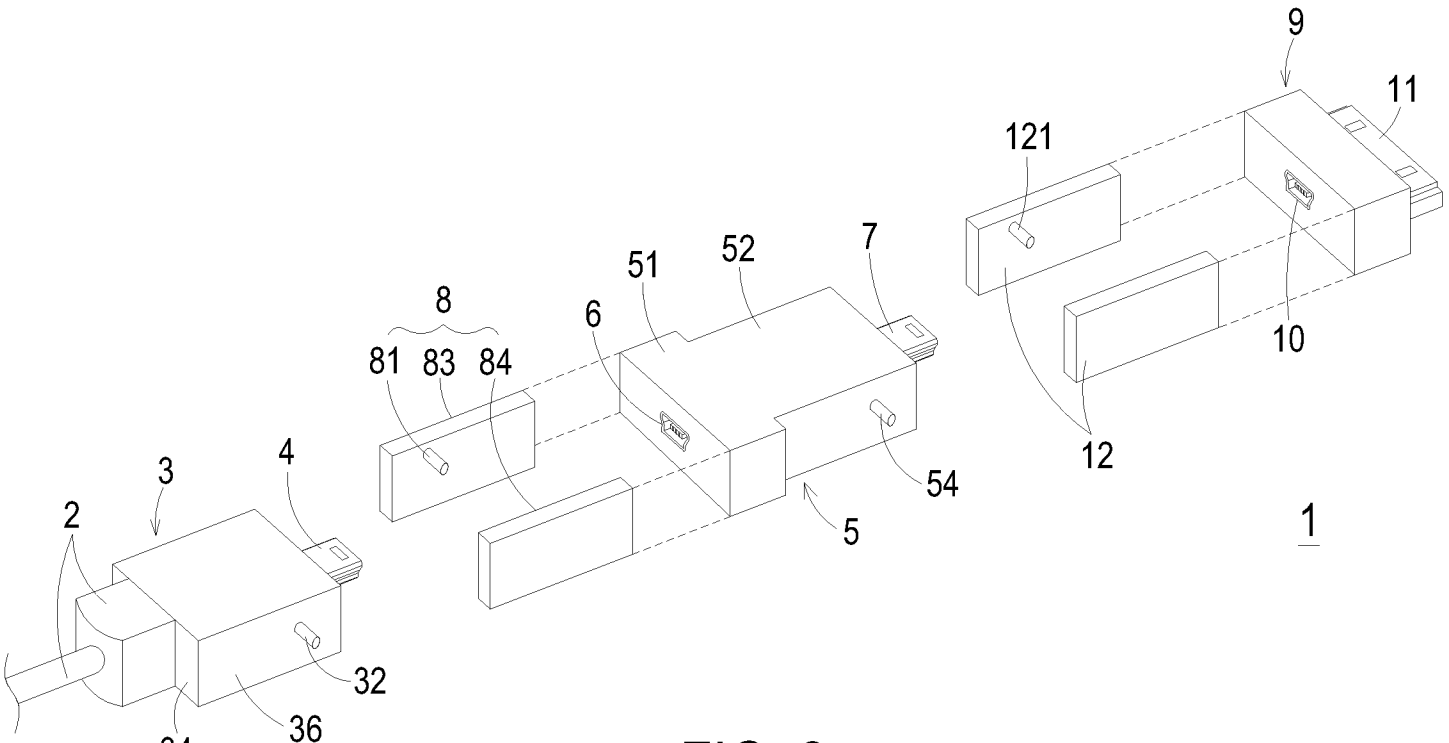
FIG. 2 is a schematic exploded view illustrating the integrated electric connector of FIG. 1 and taken along another viewpoint.

Please refer to FIGS. 1 and 2. FIG. 1 is a schematic exploded view illustrating an integrated electric connector according to an embodiment of the present invention. FIG. 2 is a schematic exploded view illustrating the integrated electric connector of FIG. 1 and taken along another viewpoint. The integrated electric connector 1 is used for connecting a transmission cable 2 and an electronic device (not shown). An example of the integrated electric connector 1 includes but is not limited to a smart phone, a tablet personal computer, a digital camera, a card reader, and an external storage medium. The integrated electric connector 1 comprises a main body 3, a first electric connector 4, a first casing 5, a second electric connector 6, a third electric connector 7, and a first guiding member 8. The main body 3 comprises a first guiding part 31 and a second guiding part 32. The first electric connector 4 is at least partially protruded from the main body 3 and connected with the transmission cable 2. The first casing 5 is located beside the first electric connector 4. The second electric connector 6 is installed in the first casing 5, and connectable with the first electric connector 4. The third electric connector 7 is disposed on the first casing 5, and connected with the second electric connector 6. In addition, the third electric connector 7 and the second electric connector 6 are located at opposite sides of the first casing 5. The first guiding member 8 is connected with the first casing 5. In addition, the first guiding member 8 comprises a third guiding part 81 and a fourth guiding part 82. The third guiding part 81 and the fourth guiding part 82 match the first guiding part 31 and the second guiding part 32 of the main body 3, respectively. Via the first guiding member 8, the first electric connector 4 is guided to be detachably connected with the second electric connector 6. Consequently, the first electric connector 4 may be directly connected with the electronic device, or the first electric connector 4 may be indirectly connected with the electronic device through the second electric connector 6 and the third electric connector 7. In other words, via the first guiding member 8, the first electric connector 4 is guided to be detachably connected with the second electric connector 6 in a foolproof manner. Consequently, the possibility of inadvertently applying force or causing improper assembling direction will be minimized.

In this embodiment, the first electric connector 4 is at least exposed outside a first surface 33 of the main body 3. The transmission cable 2 is connected with the first electric connector 4 through a second surface 34 of the main body 3 and an inner portion of the main body 3. The first surface 33 and the second surface 34 are opposed to each other. The first guiding part 31 is formed on a third surface 35 of the main body 3. The second guiding part 32 is formed on a fourth surface 36 of the main body 3.

In this embodiment, the second electric connector 6 is located at a first end part 51 of the first casing 5, and the third electric connector 7 is located at a second end part 52 of the first casing 5. The first end part 51 and the second end part 52 are opposed to each other with respect to the first casing 5. The width of the first end part 51 is larger than the width of the second end part 52. The first end part 51 is connected with the first guiding member 8, or the first guiding member 8 is at least partially received within the first end part 51. In this embodiment, the first guiding member 8 is connected with the first end part 51 of the first casing 5. In addition, the first guiding member 8 has a first lateral wall 83 and a second lateral wall 84, which are extended from the first end part 51 of the first casing 5. The third guiding part 81 is formed on the first lateral wall 83 of the first guiding member 8, and the fourth guiding part 82 is formed on the second lateral wall 84 of the first guiding member 8.

In some embodiments, the first guiding part 31 and the second guiding part 32 of the main body 3 are respectively a guiding track and a cylindrical post, and the third guiding part 81 and the fourth guiding part 82 of the first guiding member 8 are respectively another cylindrical post and another guiding track. The first guiding part 31 matches the third guiding part 81. The second guiding part 32 matches the fourth guiding part 82. In other words, the first guiding part 31 and the third guiding part 81 are complementary guiding track-cylindrical post structures, and the second guiding part 32 and the fourth guiding part 82 are complementary cylindrical post-guiding track structures. Due to these guiding track-cylindrical post structures and cylindrical post-guiding track structures, the first guiding member 8 may guide the first electric connector 4 is detachably connected with the second electric connector 6 along the tracks.

Please refer to FIGS. 1 and 2 again. The first casing 5 further comprises a first guiding part 53 and a second guiding part 54. The first guiding part 53 and the second guiding part 54 are located at the second end part 52 of the first casing 5. The integrated electric connector 1 further comprises a second casing 9, a fourth electric connector 10, a fifth electric connector 11, and a second guiding member 12. The second casing 9 is located beside the third electric connector 7. The fourth electric connector 10 is installed in the second casing 9 to be connected with the third electric connector 7. The fifth electric connector 11 is disposed on the second casing 9, and connected with the fourth electric connector 10. In addition, the fifth electric connector 11 and the fourth electric connector 10 are located at opposite sides of the second casing 9. The second guiding member 12 is connected with the second casing 9. In addition, the second guiding member 12 comprises a third guiding part 121 and a fourth guiding part 122. The third guiding part 121 and the fourth guiding part 122 match the first guiding part 53 and the second guiding part 54 of the first casing 5, respectively. In other words, the first electric connector 4 is guided to be detachably connected with the second electric connector 6 via the first guiding member 8, and the third electric connector 7 is guided to be detachably connected with the fourth electric connector 10 via the second guiding member 12. Consequently, the first electric connector 4 may be directly connected with the electronic device; or the first electric connector 4 may be indirectly connected with the electronic device through the second electric connector 6 and the third electric connector 7; or the first electric connector 4 may be indirectly connected with the electronic device through the second electric connector 6, the third electric connector 7, the fourth electric connector 10 and the fifth electric connector 11.

For example, each of the first electric connector 4, the second electric connector 6, the third electric connector 7, the fourth electric connector 10 and the fifth electric connector 11 is selected from a USB connector, a Mini USB connector, a Micro USB connector, an Apple 30-pin dock connector, a thunderbolt connector, a firewire connector, a Serial Advanced Technology Attachment connector (SATA connector), a Peripheral Component Interconnect Express connector (PCI-E connector) or an Ethernet connector. In addition, the first electric connector 4 matches the second electric connector 6, and the third electric connector 7 matches the fourth electric connector 10.

Figure 3:
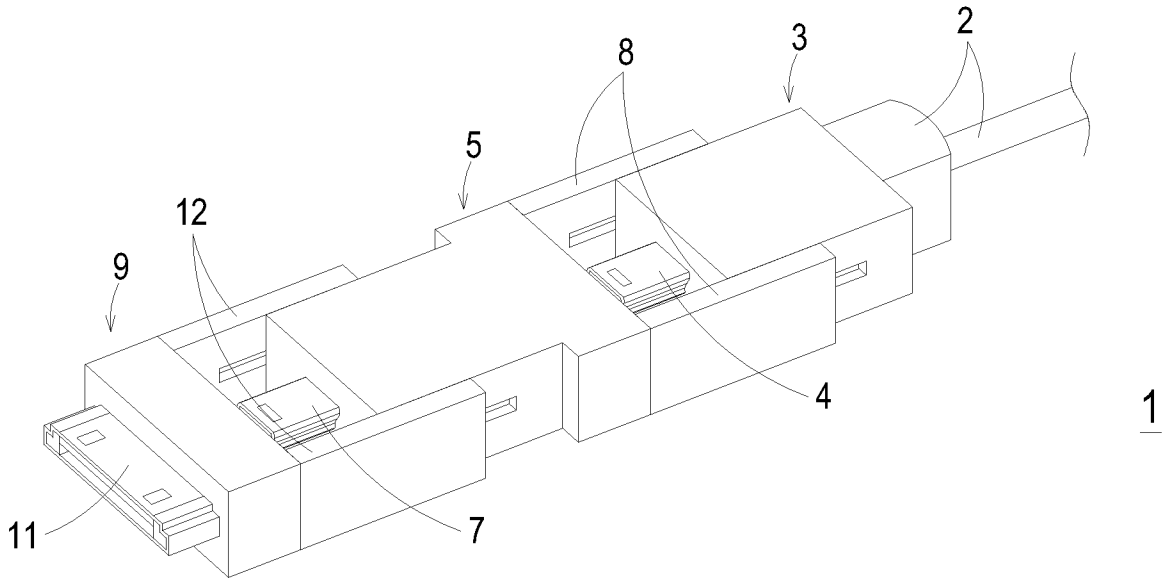
FIG. 3 schematically illustrates a process of connecting and guiding the integrated electric connector according to an embodiment of the present invention.

FIG. 3 schematically illustrates a process of connecting and guiding the integrated electric connector according to an embodiment of the present invention. As shown in FIG. 3, the first electric connector 4 is guided to be detachably connected with the second electric connector 6 via the first guiding member 8, and the third electric connector 7 is guided to be detachably connected with the fourth electric connector 10 via the second guiding member 12 (see also FIG. 2). Consequently, the first electric connector 4, the third electric connector 7 or the fifth electric connector 11 is selectively connected with the electronic device according to the type of the electric connector of the electronic device.

Figure 4:
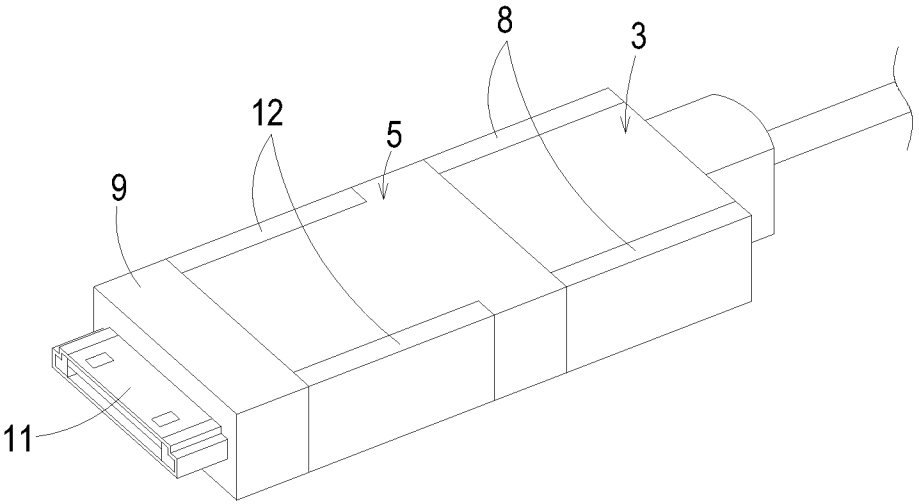
FIG. 4 is a schematic assembled view illustrating the integrated electric connector according to an embodiment of the present invention, in which the fifth connector is selected to be connected with the electronic device.

FIG. 4 is a schematic assembled view illustrating the integrated electric connector according to an embodiment of the present invention, in which the fifth connector is selected to be connected with the electronic device. Please refer to FIGS. 2, 3 and 4. For selecting the fifth electric connector 11 to be connected with the corresponding electronic device 20, the first electric connector 4 is guided to be connected with the second electric connector 6 via the first guiding member 8, and the third electric connector 7 is guided to be connected with the fourth electric connector 10 via the second guiding member 12. In such way, the first electric connector 4 is indirectly connected with the electronic device through the second electric connector 6, the third electric connector 7, the fourth electric connector 10 and the fifth electric connector 11.

Figure 5:
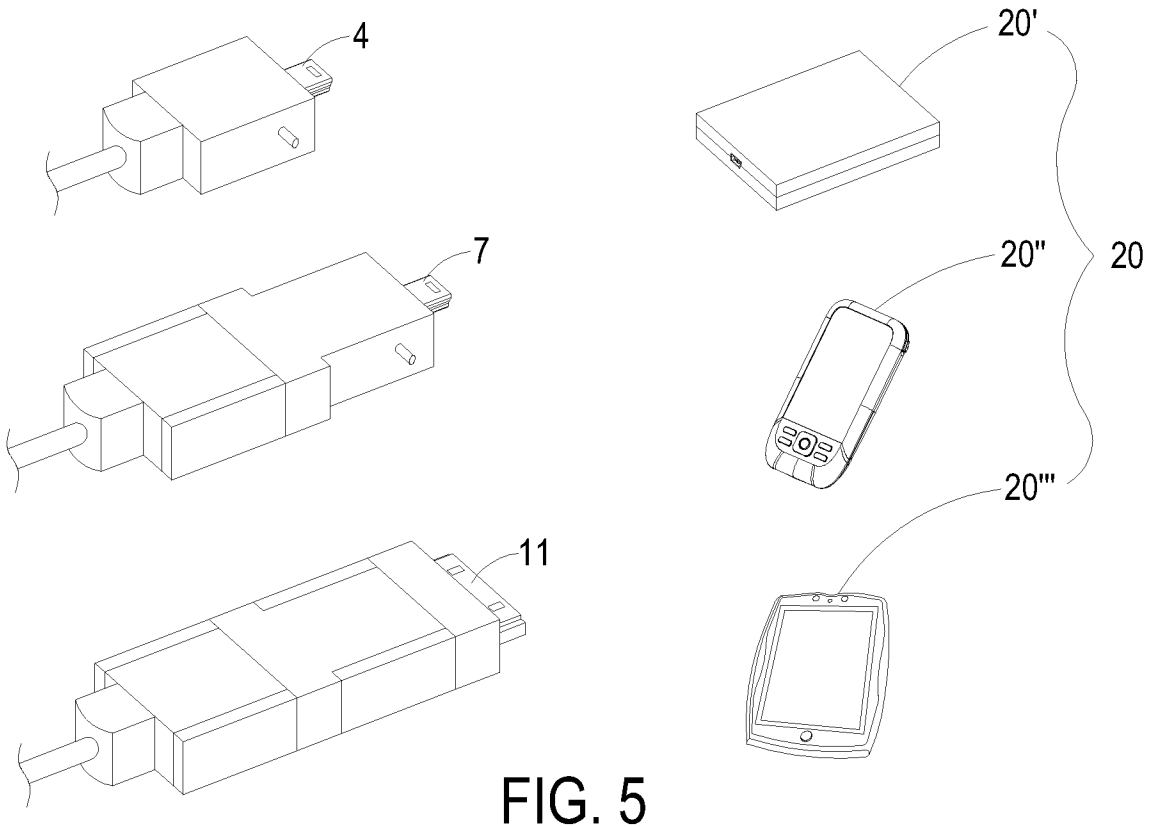
FIG. 5 schematically illustrates the concepts of selecting a suitable type of electronic connector to be connected with an electronic device according to the practical requirements.

FIG. 5 schematically illustrates the concepts of selecting a suitable type of electronic connector to be connected with an electronic device according to the practical requirements. As shown in FIG. 5, the first electric connector 4, the third electric connector 7 or the fifth electric connector 11 of the integrated electric connector may be selectively connected with the electronic device 20 according to the type of the electric connector of the electronic device 20. For example, in some embodiments, the first electric connector 4 is a Mini USB connector complying with an external storage medium 20', the third electric connector 7 is a Micro USB connector complying with a smart phone 20", and the fifth electric connector 11 is an Apple 30-pin dock connector complying with a tablet personal computer 20'''. Via the first guiding member 8 and the second guiding member 12, a desired electric connector is selected to be connected with the corresponding electronic device 20. Moreover, for selecting the first electric connector 4 or the third electric connector 7 to be connected with the corresponding electronic device 20, the unused components at the front side of the integrated electric connector 1 may be removed. For example, if the third electric connector 7 is selected to be connected with the smart phone 20", the unused components (e.g. the second casing 9, the fourth electric connector 10, the fifth electric connector 11 and the second guiding member 12) may be removed. For example, if the first electric connector 4 is selected to be connected with the external storage medium 20', the unused components (e.g. the first casing 5, the second electric connector 6, the third electric connector 7, the first guiding member 8, the second casing 9, the fourth electric connector 10, the fifth electric connector 11 and the second guiding member 12) may be removed.

Figure 6B:
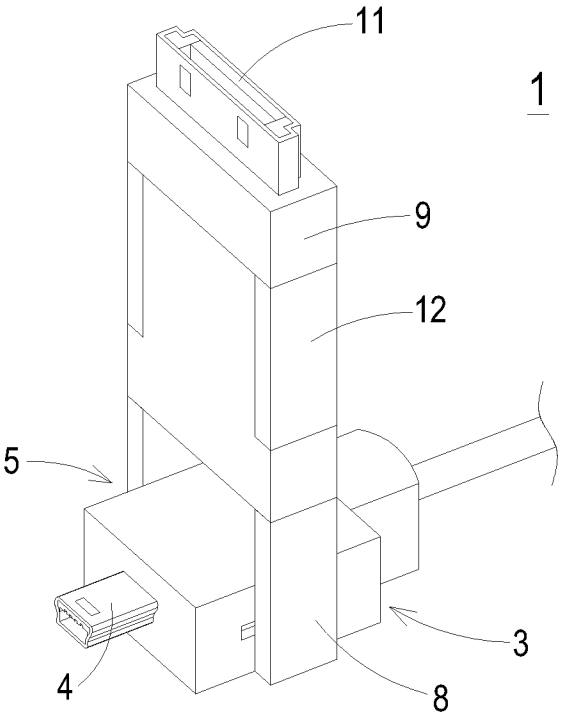
FIG. 6B is a schematic assembled view illustrating the integrated electric connector according to an embodiment of the present invention, in which the first guiding member is rotated relative to the main body.
Figure 6A:
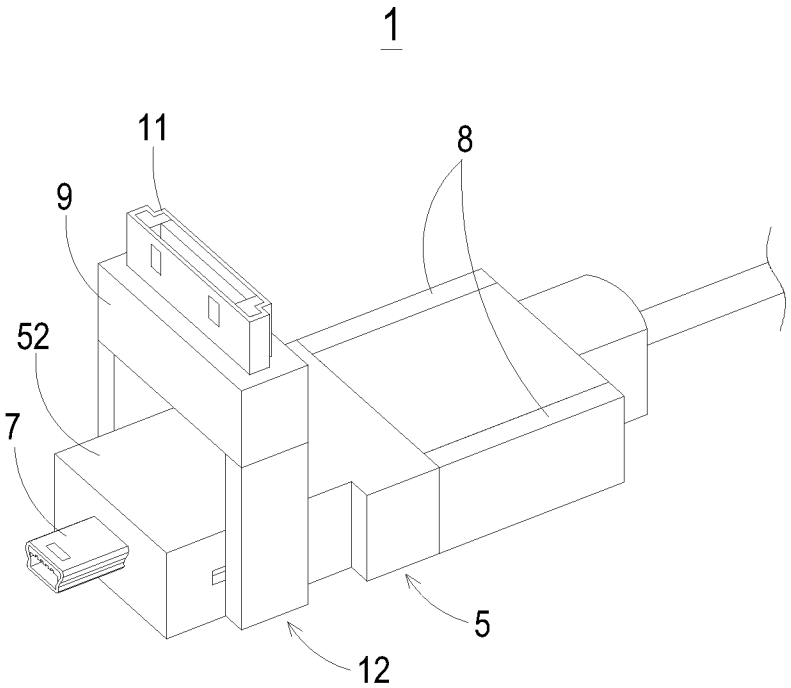
FIG. 6A is a schematic assembled view illustrating the integrated electric connector according to an embodiment of the present invention, in which the second guiding member is rotated relative to the first casing.

Moreover, for selecting the first electric connector 4 or the third electric connector 7 to be connected with the corresponding electronic device 20, the unused components at the front side of the integrated electric connector 1 may be rotated to other places. Please refer to FIGS. 6A and 6B as well as FIGS. 2 and 5. FIG. 6A is a schematic assembled view illustrating the integrated electric connector according to an embodiment of the present invention, in which the second guiding member is rotated relative to the first casing. FIG. 6B is a schematic assembled view illustrating the integrated electric connector according to an embodiment of the present invention, in which the first guiding member is rotated relative to the main body.

Please refer to FIG. 6A. For selecting the third electric connector 7 to be connected with the smart phone 20", the first electric connector 4 is guided to be connected with the second electric connector 6 via the first guiding member 8, so that the first electric connector 4 is indirectly connected with the third electric connector 7 through the second electric connector 6. Since the third guiding part 121 of the second guiding member 12 and the second guiding part 54 of the first casing 5 are both cylindrical posts, the second guiding member 12 may be rotated relative to the first casing 5 by using the third guiding part 121 of the second guiding member 12 and the second guiding part 54 of the first casing 5 as the fulcrums. Correspondingly, the second casing 9, the fourth electric connector 10 and the fifth electric connector 11 are also rotated relative to the first casing 5. Meanwhile, since the third electric connector 7 is no longer hindered, the third electric connector 7 is connectable with the smart phone 20". Please refer to FIG. 6B. For selecting the first electric connector 4 to be connected with the external storage medium 20', the first guiding member 8 may be rotated relative to the main body 3 by using the third guiding part 81 of the first guiding member 8 and the second guiding part 32 of the main body 3 as the fulcrums. Correspondingly, the first casing 5, the second electric connector 6, the third electric connector 7, the second guiding member 12, the second casing 9, the fourth electric connector 10 and the fifth electric connector 11 are also rotated relative to the main body 3. Meanwhile, since the first electric connector 4 is no longer hindered, the first electric connector 4 is connectable with the external storage medium 20'. From the above discussions, since the guiding member and the casing are rotatable, the desired electric connector may be selected according to the user's requirement without the need of disassembling any components. In other words, the integrated electric connector of the present invention is easily stored, and the possibility of losing any component of the integrated electric connector will be minimized.

From the above description, the present invention provides an integrated electric connector and a connecting and guiding mechanism thereof. Via the guiding member, the first electric connector is guided to be detachably connected with the second electric connector. Since the connecting and guiding mechanism has a foolproof function, the possibility of inadvertently applying force or causing improper assembling direction will be minimized. Moreover, since the guiding member and the casing are rotatable, the desired electric connector may be selected according to the user's requirement without the need of disassembling any components. In other words, the integrated electric connector of the present invention is easily stored, and the possibility of losing any component of the integrated electric connector will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated electric connector for connecting a transmission cable with an electronic device, said integrated electric connector at least comprising:

a main body comprising a first guiding part and a second guiding part;

a first electric connector at least partially protruded from said main body and connected with said transmission cable, wherein said first electric connector is at least exposed outside a first surface of said main body and said transmission cable is connected with a second surface of said main body, and wherein said first surface and said second surface are opposed to each other with respect to said main body, wherein said first guiding part is formed on a third surface of said main body and said second guiding part is formed on a fourth surface of said main body, and wherein said first guiding part is a guiding track and said second guiding part is a cylindrical post;

a casing located beside said first electric connector;

a second electric connector installed in said casing, and connectable with said first electric connector;

a third electric connector disposed on said casing and connected with said second electric connector, wherein said second electric connector and said third electric connector are opposed to each other with respect to said casing; and a guiding member connected with said casing, and comprising a third guiding part and a fourth guiding part, wherein said third guiding part and said fourth guiding part match said first guiding part and said second guiding part, respectively, wherein said first electric connector is guided by said guiding member to be detachably connected with said second electric connector, wherein said first electric connector is directly connected with said electronic device, or said first electric connector is indirectly connected with said electronic device through said second electric connector and said third electric connector.

2. The integrated electric connector according to claim 1, wherein said third guiding part is another cylindrical post, and said fourth guiding part is another guiding track.

3. The integrated electric connector according to claim 1, wherein said casing has a first end part and a second end part, which are disposed on bilateral side of said casing, wherein a width of said first end part is larger than a width of said second end part.

4. The integrated electric connector according to claim 3, wherein said second electric connector is located at said first end part of said casing, and said third electric connector is located at said second end part of said casing.

5. The integrated electric connector according to claim 4, wherein said guiding member is connected with said first end part of said casing, and said guiding member has a first lateral wall and a second lateral wall extended from said first end part of said casing, wherein said third guiding part is formed on said first lateral wall, and said fourth guiding part is formed on said second lateral wall.

6. A connecting and guiding mechanism of an integrated electric connector, a transmission cable being connected with an electronic device through said integrated electric connector, said integrated electric connector comprising a main body and a first electric connector, said first electric connector is at least exposed outside a first surface of said main body, said transmission cable is connected with a second surface of said main body, said main body having a first guiding part and a second guiding part, said first guiding part is formed on a third surface of said main body and said second guiding part is formed on a fourth surface of said main body, said first guiding part is a guiding track and said second guiding part is a cylindrical post, said first electric connector being at least partially protruded from said main body and connected with said transmission cable, said connecting and guiding mechanism at least comprising:

a casing located beside said first electric connector;

a second electric connector installed in said casing, and connectable with said first electric connector;

a third electric connector disposed on said casing and connected with said second electric connector, wherein said second electric connector and said third electric connector are opposed to each other with respect to said casing; and a guiding member connected with said casing, and comprising a third guiding part and a fourth guiding part, wherein said third guiding part and said fourth guiding part match said first guiding part and said second guiding part, respectively, wherein said first electric connector is guided by said guiding member to be detachably connected with said second electric connector, wherein said first electric connector is directly connected with said electronic device, or said first electric connector is indirectly connected with said electronic device through said second electric connector and said third electric connector, wherein said third guiding part is another cylindrical post, and said fourth guiding part is another guiding track.

7. An integrated electric connector for connecting a transmission cable with an electronic device, said integrated electric connector at least comprising:

a main body comprising a first guiding part and a second guiding part;

a first electric connector at least partially protruded from said main body and connected with said transmission cable;

a first casing located beside said first electric connector, wherein said first casing has another first end part and another second end part, and said first guiding part and said second guiding part are located at said second end part of said first casing;

a second electric connector installed in said first casing, and connectable with said first electric connector;

a third electric connector disposed on said second end part of said first casing and connected with said second electric connector, wherein said second electric connector and said third electric connector are opposed to each other with respect to said first casing;

a first guiding member connected with said first end part of said first casing, and comprising a third guiding part and a fourth guiding part, wherein said third guiding part and said fourth guiding part of said first guiding member match said first guiding part and said second guiding part of said main body, respectively;

a second casing located beside said third electric connector;

a fourth electric connector installed in said second casing, and connectable with said third electric connector;

a fifth electric connector disposed on said second casing and connected with said fourth electric connector, wherein said fourth electric connector and said fifth electric connector are opposed to each other with respect to said second casing; and a second guiding member connected with said second casing, and comprising another third guiding part and another fourth guiding part, wherein said third guiding part and said fourth guiding part of said second guiding member match said first guiding part and said second guiding part of said first casing, respectively;

wherein said first electric connector is guided by said first guiding member to be detachably connected with said second electric connector, and said third electric connector is guided by said second guiding member to be detachably connected with said fourth electric connector, wherein said first electric connector is directly connected with said electronic device, or said first electric connector is indirectly connected with said electronic device through said second electric connector and said third electric connector, or said first electric connector is indirectly connected with said electronic device through said second electric connector, said third electric connector, said fourth electric connector and said fifth electronic connector.

* * * * *